US005106229A

United States Patent [19]

Blackwell

[11] Patent Number: 5,106,229

[45] Date of Patent: Apr. 21, 1992

[54] IN GROUND, RIGID POOLS/STRUCTURES; LOCATED IN EXPANSIVE CLAY SOIL

[76] Inventor: William A. Blackwell, 13850 Compton Rd., Clifton, Va. 22024

[21] Appl. No.: 594,701

[22] Filed: Oct. 9, 1990

[51] Int. Cl.[5] ..... E02B 1/00

[52] U.S. Cl. ..... 405/52; 52/169.5; 4/506; 405/43; 405/53

[58] Field of Search ..... 405/52, 53, 128, 129, 405/36, 43, 45; 52/169.14, 169.11, 169.55, 169.7, 393; 4/506, 507, 504, 505

[56] References Cited

U.S. PATENT DOCUMENTS

| | | | |
|---|---|---|---|
| 3,374,491 | 3/1968 | Patin et al. | 4/506 X |
| 3,429,085 | 2/1969 | Stillman | 52/169.14 X |
| 3,816,234 | 6/1974 | Winfield | 4/506 X |
| 4,409,772 | 10/1983 | Boyack | 52/169.7 X |
| 4,584,802 | 4/1986 | Casselman et al. | 52/169.7 |
| 4,730,953 | 3/1988 | Tarko | 405/45 |

*Primary Examiner*—Dennis L. Taylor

[57] ABSTRACT

A rigid type swimming pool or other rigid type structure formed in the ground in which the excavated sides and bottom provides the form for the rigid shell, is subject to increased pressures from the soil, where the surrounding soil is of the expansive clay type. Clay, being of fine soil particles, expands when there is the presence of water, and contracts when there is loss of water. In such a case, flexible, porous expansion material can be placed between the soil and shell to provide room for this movement when the clay soil expands and contracts; due to the variable water percentage present at any given time.

1 Claim, 1 Drawing Sheet

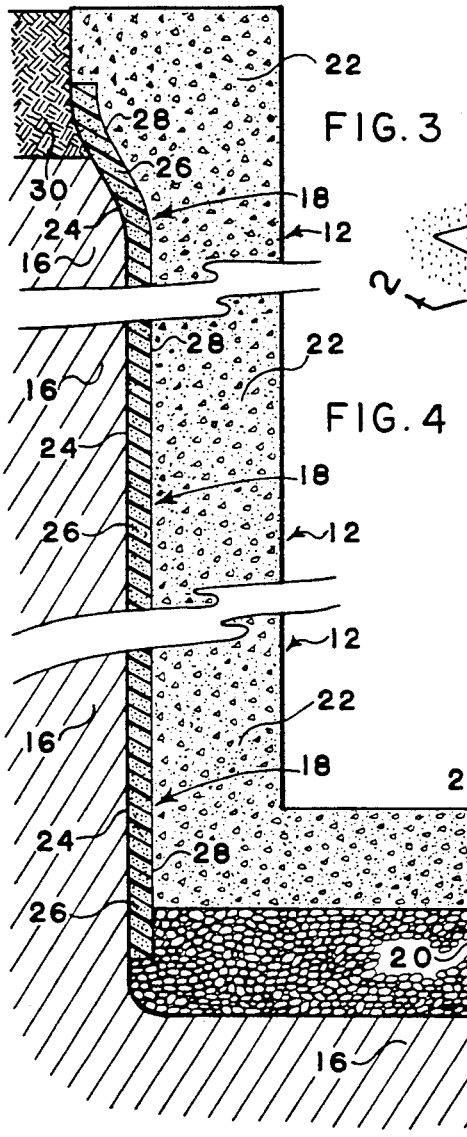
FIG. 3
FIG. 4
FIG. 5
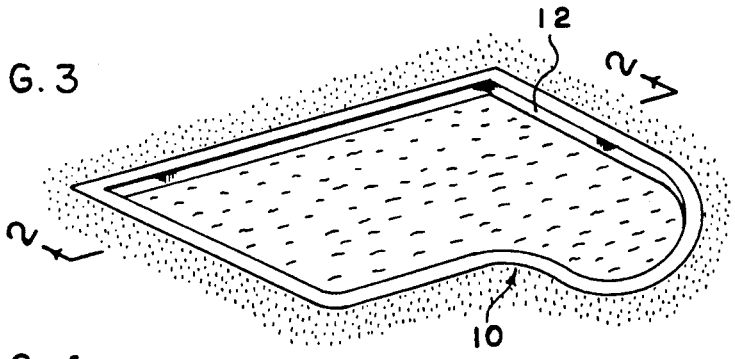
FIG. 1
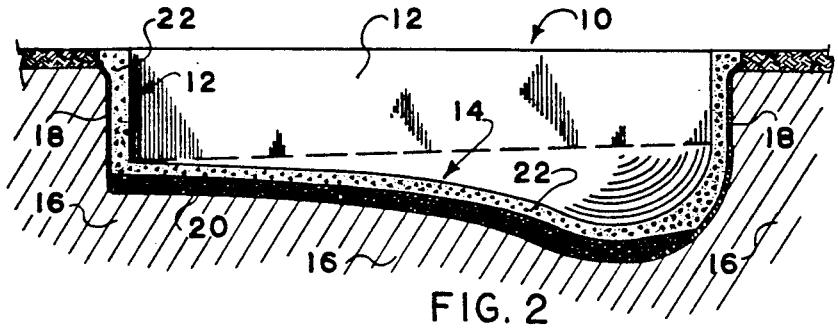
FIG. 2

IN GROUND, RIGID POOLS/STRUCTURES; LOCATED IN EXPANSIVE CLAY SOIL

BACKGROUND OF THE INVENTION

Field of the invention.: In ground fabricated rigid pools and structures, which are located in expansive clay type soil.

Description of the prior art.: A rigid pool or structure which is fabricated in ground, the soil of which is comprised of expansive clay type, has to have the area over excavated well beyond the outside surfaces of the walls and floors, the structure formed and poured in place, and the over excavated area backfilled with non-expansive soil.

SUMMARY OF THE INVENTION

It is an object of the present invention to provide a rigid pool or structure which is easily and inexpensively fabricated, when the surrounding soil is of expansive clay type.

It is another object of the present invention to provide a rigid pool or structure which can be fabricated in virtually any shape or configuration within as expansive clay type soil.

It is another object of the present invention to provide a flexible perimeter around a rigid pool or structure that separates it from the surrounding expansive clay soil.

A further object of the present invention is to provide a rigid pool or structure with a means of draining any water that reaches the sides, downwards and off; thereby preventing hydrostatic pressure buildup.

It is still a further object of the present invention to provide a rigid pool or structure with a means of maintaining the surrounding clay soil with as stable moisture content as possible throughout the variable weather seasons.

Essentially, but not by way of limitation, the present invention comprises a rigid pool or structure that is located in expansive clay soil, to have a flexible, drainage type material placed against the clay strata. Against this surface can be poured, placed, or shot, the final surface material. This surface treatment is normally, but not limited to a cement base material.

BRIEF DESCRIPTION OF THE DRAWING

In the drawing:

FIGURE 1. is a pictorial representation of a pool for the present invention, which includes water therein.

FIG. 2. is a cross section taken across line 2—2 of FIG. 1, minus the water.

FIG. 3. is a blow up detail of a typical wall section portion, at the top of clay area.

FIG. 4. is a blow up detail of a typical wall section portion, at a mid area.

FIG. 5. is a blow up detail of a typical wall and floor intersect.

DESCRIPTION OF THE PREFERRED EMBODIMENT

The swimming pool 10 shown as an example for the present invention consist of an in ground earth supported structure, with walls 12 and floor 14.

The surrounding earth support consist of expansive clay type soil 16. The excavation is shaped to conform to the structure outside face; including the flexible material layers 18.

Floor 14 comprises a bottom layer of stone 20 which is installed immediately after the excavation process, to prevent loss of moisture from the soil during construction, to provide a clean working surface, and later provide an area for water to be collected and drained. The structural floor 22 consist of a rigid material, usually cement based. This floor can be installed separately from the walls, but in some cases such as swimming pools, the floor and walls are installed by pressure hose applied gunite or shotcrete.

Wall 12 consist of a vapor barrier 24, which is placed against the excavated wall areas immediately after the excavation is completed, to retard moisture loss from the clay soil during construction. Adjacent to the vapor barrier is installed flexible porous material 26, which provides for expansion and contraction between the rigid shell and the expansive clay soil, and drainage of water. The inner surface is then covered with a sheet of plastic 28, or other similar material, to prevent the flexible material from being contaminated with the structural wall material 22 during the installation process. The structural wall material 22 is usually the same material as the structural floor material 22. The top of wall is similar to the mid area wall, except that the top of the clay 16 is to be final located just below the top of flexible material layers 18. This is to prevent carry over stresses into the structural wall material 22, from the expansive clay. The final finish grade soil 30 is a non-expansive type soil.

What is claimed is:

1. An excavated in ground rigid swimming pool, pool, or structure, founded in expansive clay soil, comprising:

(a) an in ground earthen form, said earthen form excavated to the desired configuration; and (b) flexible, porous type material positioned against the expansive clay soil along the sides of said form, and natural stone positioned against the bottom of said form, said flexible material comprising:

(i) two outer layers of plastic, or similar material; and (ii) one inner layer of flexible and porous natural or synthetic material, of thickness required; and (c) a rigid structural shell positioned in ground adjacent to the stone covered bottom, and flexible material covered sides.

* * * * *